United States Patent [19]

Wright

[11] Patent Number: 4,602,609

[45] Date of Patent: Jul. 29, 1986

[54] GAS FIRE APPLIANCES

[75] Inventor: Peter Wright, Sutton Coldfield, England

[73] Assignee: Valor Heating Limited, Birmingham, England

[21] Appl. No.: 725,100

[22] Filed: Apr. 19, 1985

[30] Foreign Application Priority Data

Feb. 7, 1985 [GB] United Kingdom ..... 8503085

[51] Int. Cl.[4] ..... F24C 3/04

[52] U.S. Cl. ..... 126/92 AC; 126/92 R; 126/127; 431/125; 431/278

[58] Field of Search ..... 126/86, 92 R, 92 AC, 126/127, 128, 129; 431/125, 278, 281

[56] References Cited

U.S. PATENT DOCUMENTS 4,306,537 12/1981 Mitchell ..... 126/92 AC

FOREIGN PATENT DOCUMENTS 284867 2/1928 United Kingdom ..... 126/92 R 956068 4/1964 United Kingdom ..... 126/92 R 2133530 7/1984 United Kingdom ..... 126/127

*Primary Examiner*—Margaret A. Focarino

[57] ABSTRACT

This invention relates to a gas fire appliance of the kind which simulates an open fire burning solid fuel. In accordance with the invention such a gas fire appliance comprises a casing in which is mounted a support on which solid fuel simulating elements are supported, a transparent panel above and in front of said solid fuel simulating elements and a burner assembly. The burner assembly comprises a heater burner portion having burners disposed in at least two independently controllable sections together with a flame effect burner portion which also has burners disposed in at least two independently controllable sections. Conveniently the heater burner portion and the flame effect burner portion each has two sections namely an inner section and an outer section disposed on opposite sides of the respective inner section.

3 Claims, 4 Drawing Figures

GAS FIRE APPLIANCES

Figure 1:
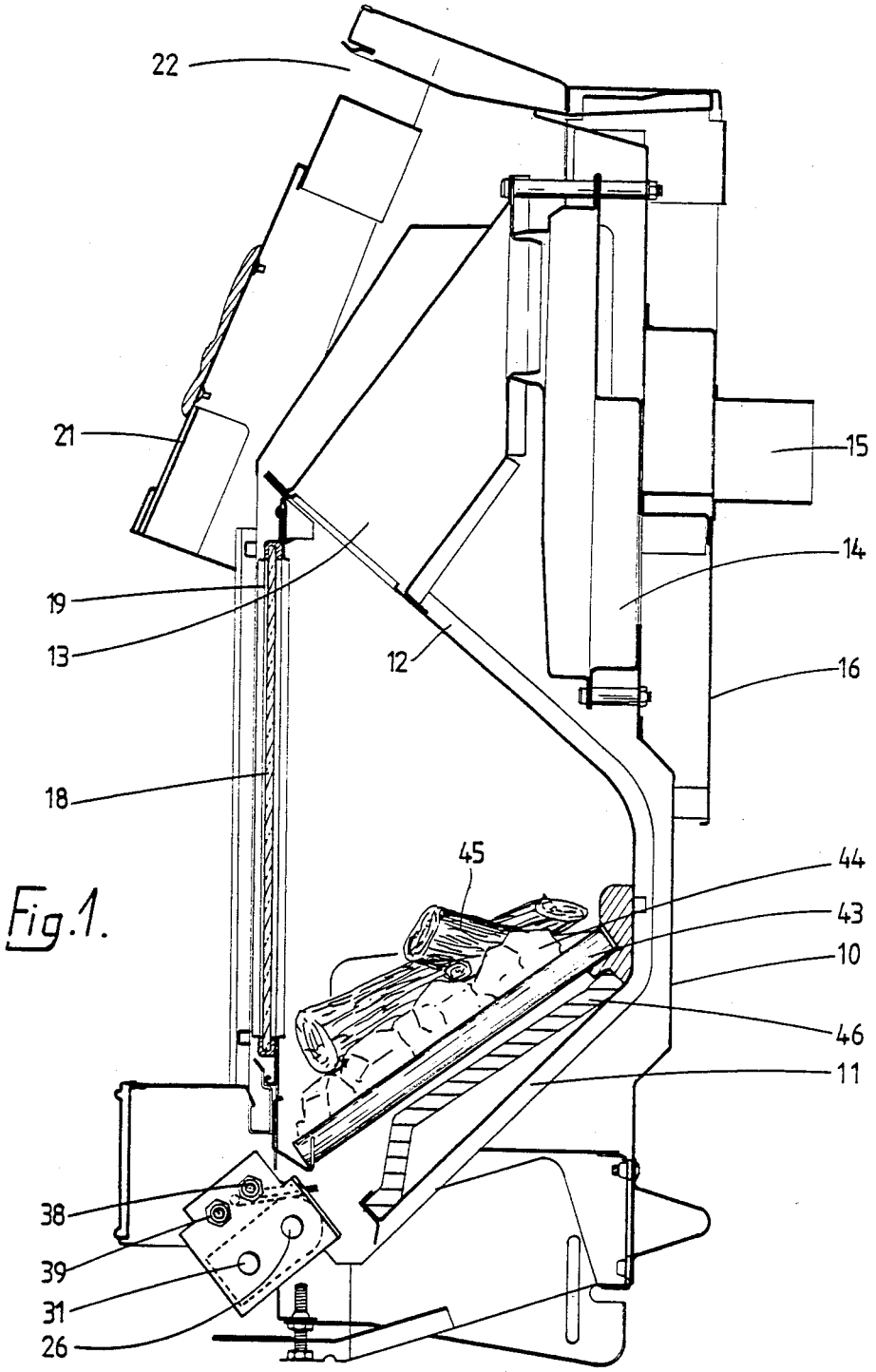

This invention relates to gas fire appliances of the kind which, while having a supply of gas to be burnt to product heat, give the appearance of an open fire with coal, coke or logs, that is solid fuel.

There have been many attempts in gas fire to simulate a solid fuel open fire including illumination, sometimes electrically from below, of a structure giving the appearance of coal or wood, the effect of flames sometimes being enhanced by colour effects as well as by interruption of the light, for instance by a bladed fan. The open fire simulating portion in such a gas fire produces no direct heating, this being provided instead by conventional quite separate ceramic open sided columns through which the gas is burnt to heat the columns so that they produce radiant heat. This source of radiant heating is often supplemented by passing the products of combustion therefrom through a heat exchanger which is used to heat further air drawn through the appliance by convection. It has also been proposed to provide for some of the gas burning to take place below the simulated coal or logs structure, which however, in such conventional appliances, is a continuous sheet, so that none of the combustion products escape through it. With such an arrangement it is still necessary to provide, for the major source of heating, radiant and possibly also convention sources of the kind described.

A further known arrangement is one in which the gas is passed through sand, emerging and burning around the simulated coal or logs which are separate elements. This gives a better effect since it provides the appearance of live flames around the coal or logs but the effect is still not particularly realistic of an open solid fuel fire.

It is the object of the invention to provide a gas fire appliance in which the appearance of a solid fire is more realistically simulated.

According to the invention there is provided a gas fire appliance comprising a casing carrying a support on which solid fuel simulating elements are supported, a transparent panel above and in front of the solid fuel simulating elements and at least partially enclosing the space defined within the casing above the solid fuel simulating elements and a burner assembly through which, in use, gas to be burnt is supplied, said burner assembly comprising a heater burner portion which is arranged to direct gas to be burnt below the support for the solid fuel simulating elements for the primary purpose of heating those elements and which has burners disposed in at least two independently controllable sections, and a flame effect burner portion which is also arranged to direct gas below the solid fuel simulating elements and above the main burner portion, the flame effect burner portion being arranged primarily to supply gas for producing visible flame effect between the solid fuel simulating elements and also having burners disposed in at least two independently controllable sections.

Conveniently the sizes of nozzles forming on the one hand parts of the heater burners and, on the other hand, parts of the flame effect burners differ, the gas directed from the flame effect burner nozzles being arranged in use to be burnt in the presence of a lower proportion of air than is the case for the heater burner nozzles, so that the flames are visible therefrom.

Figure 2:
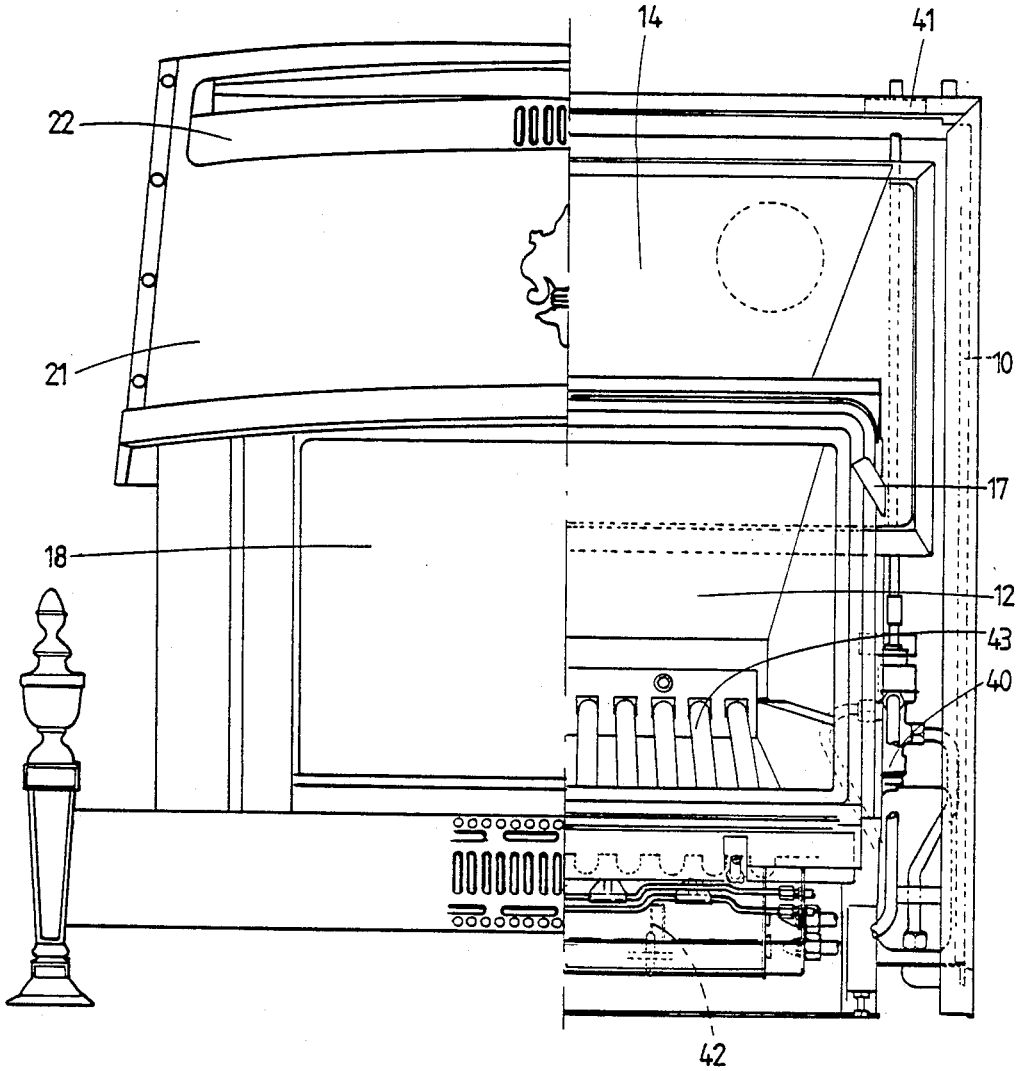
Figure 3:
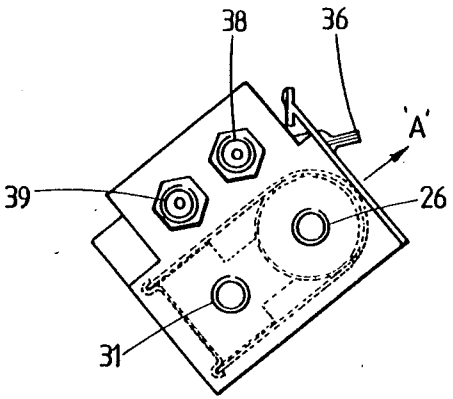
Figure 4:
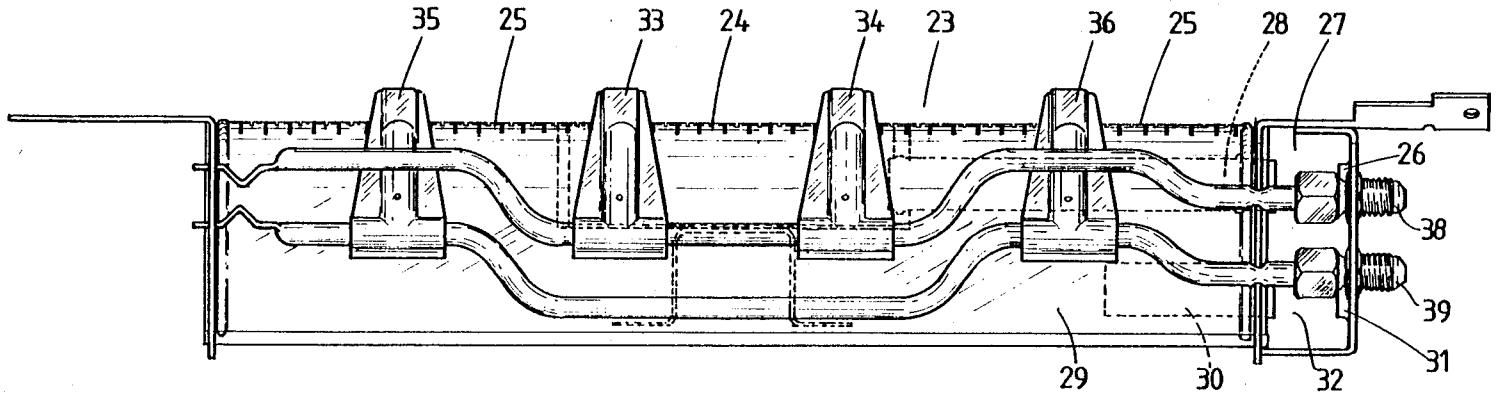

The invention will now be described by way of example with reference to the accompanying drawings in which, FIG. 1 is a cross-sectional side elevation view of a gas fire appliance constructed in accordance with the invention, FIG. 2 is a partly broken away view of the gas fire appliance, FIG. 3 is an end elevation view of the burner assembly of the appliance and, FIG. 4 is a plan view of part of the burner assembly.

FIGS. 1 and 2 show a multi part frame 10 for the appliance. The frame has air inlet openings at the front lower end for the entry of air for combustion purposes. The main central portion of the frame defines a full width cavity with lower and upper baffle plates 11, 12 converging upwardly and downwardly towards the rear. In the upper plate 12 which serves as a reflector plate is a flue opening or openings 13 which communicate with a heat exchanger 14 mounted in the upper part of the frame. From the heat exchanger is a flue outlet 15. A baffle 16 at the rear of the frame defines a back pressure outlet of known kind.

Fixed to the front of the frame by clips 17 (see FIG. 2) in detachable manner is a transparent panel 18. This is sealed around the edges except at the lower edge at which an opening for air entry is defined. Enclosing the front of the frame are removable casing parts 21 having decorative form and giving a decorative appearance to the whole appliance. An upper portion of this includes an outlet 22 for air which has been heated by passage over the heat exchanger 14.

The transparent panel 18 is also carried in a support structure at the two sides of the fire as indicated at 19 and it may be of any heat resisting glass or similar material and may be wholly transparent or translucent in certain portions to provide a desired visual effect.

Below the lower edge of said transparent panel 18 and mounted in the lower front end of the casing is a burner assembly also shown in FIGS. 3 and 4. The burner assembly is mounted in suitable brackets formed in the frame 10.

FIG. 4, which is a plan view of the burner assembly, shows a heater burner portion 23 having a number of outlets which in this example are in the form of narrow vertical slots spaced along its length. This heater burner portion has at least two independently controllable sections and in this case there are in fact two such sections, namely an inner section 24 and an outer section 25 which lies on either side of the inner section 24. The narrow slot outlets of the inner section 24 are provided with a nozzle 26 which entrains air from a gap 27 to form a combustible mixture which then passes along a pipe 28 and thence into a box formed below said inner section slots 24. The outer section burner slots 25 are provided with a combustible mixture which enters into a chamber 29 via a pipe 30 which receives gas from a nozzle 31, air again being entrained from a gap 32 before the combustible mixture enters the pipe 30. The combustible gas and air mixture issuing from the slots in said sections 24 and/or 25 (it being understood that the supply of gas to such sections can be independently controlled) is directed in an upwardly and rearwardly inclined direction as indicated by the arrow 'A' in FIG. 3.

There is also provided a flame effect burner portion which again comprises at least two independently controllable sections, there being in the example illustrated two such sections namely an inner section comprising two burners 33 and 34 and an outer section comprising two further burners 35 and 36. The nozzle of each of such flame effect burners includes a flattened tubular end portion directed rearwardly of the gas fire appliance, all of said burners 33, 34, 35 and 36 being positioned above the heater burner portion so that said nozzles discharge at positions above the outlet slots of the heater burner portion. The two burners 33 and 34 forming the inner section of the flame effect burner portion are supplied with gas through a connection 38 and the outer burners 35 and 36 of said flame effect burner portion are supplied through a gas connection 39. Said flame effect burners 33, 34, 35 and 36 are supplied with air through suitable apertures formed in the burners but such apertures provide a lower air content than is the case with the heater burner outlets so that ignition of the combustible mixture issuing from the burners 33, 34, 35 and 36 will result in flames which are luminous and more visible than is the case with the flames issuing from the heater burner portion.

Ignition arrangements are also provided for lighting the gas in the required section when the supply is turned on. This is controlled through a remotely operated valve 40 connected to an operating knob 41 at the top of the appliance. A device 42 for detecting absence of flame is also provided to ensure that the gas cannot be inadvertently left on but unlit. The pipes which are connected to said connections 38 and 39 as well as pipes connected to the nozzles 26 and 31 are connected to the valve 40 and the arrangement is such that the whole burner assembly comprising the heater burner portion and the flame effect burner portion can be fed with gas from this control valve so that either the inner section 24 together with the two inner burners 33 and 34 can be fed with gas or alternatively both sections 24 and 25 together with all the burners 33, 34, 35 and 36 can be supplied with gas. In other words the arrangement is such that either the two central parts of the heater burner portion and the flame effect burner portion can be supplied with gas or alternatively all sections of both such portions can be supplied with gas.

Within the cavity defined by the plates 11, 12 and the sides of the casing there is mounted an assembly of parallel upwardly and rearwardly inclined round section ceramic support rods 43 carried in bearers in the frame 10. Fuel elements called "coke frets" 44 which give the appearance of coke are mounted on the rods 43. These are very generally of 8-shape in plan in this example. Mounted in turn on these are solid fuel simulating elements 45 loosely piled on the frets 44. In this example these are shaped as logs and simulate a conventional open fire. This assembly may include simulated logs and/or coal or other solid fuel.

Beneath the rods 43 and mounted on the lower plate 11 is a ceramic flame deflector 46 arranged to direct flames from the burner assembly upwards.

In use the burner assembly discharges gas to the space between the lower plate 11 with its flame deflector 46 and the ceramic rods 43, the heater burner portion discharging below the flame effect burner portion. The heater burner portion (either one or both sections thereof) is primarily intended for heating the solid fuel simulating elements 44 and 45 and the amount of air supplied for combustion of this gas is regulated to provide the most efficient burning for the purpose. The flames thus produced are nearly invisible.

As previously mentioned however the flame effect burner portion has a lower air content in its combustible mixture so as to produce flames which are luminous and more visible and these flames pass between the ceramic rods 43 and the solid fuel simulating elements 44 and 45. Such flames therefore produce a simulated flame effect which gives a very realistic impression of an open fire.

The spacing and arrangement of the outlet slots in the heater burner portion and of the nozzles in the flame effect burner portion can be chosen to produce any desired distribution of flame effect and of heating effect and the forms of said slots and nozzles may be varied from those shown.

I claim:

1. A gas fire appliance comprising a casing carrying a support on which solid fuel simulating elements are supported, a transparent panel above and in front of the solid fuel simulating elements and at least partially enclosing the space defined within the casing above the solid fuel simulating elements and a burner assembly through which, in use, gas to be burnt is supplied, said burner assembly comprising a heater burner portion which is arranged to direct gas to be burnt below the support for the solid fuel simulating elements for the primary purpose of heating those elements and which has burners disposed in two independently controllable sections namely an inner section and an outer section disposed on either side of the inner section, and a flame effect burner portion which is also arranged to direct gas below the solid fuel simulating elements and above the heater burner portion, the flame effect burner portion being arranged primarily to supply gas for producing visible flame effect between the solid fuel simulating elements and also having burners disposed in two independently controllable sections, namely an inner section and an outer section disposed on either side of the inner section, control means being also provided for feeding gas simultaneously either to both of said inner sections or alternatively to all of said sections.

2. A gas fire appliance as claimed in claim 1 wherein the burners of the heater burner portion each comprise a narrow vertical slot.

3. A gas fire appliance as claimed in claim 1 wherein the inner section and the outer section of the flame effect burner portion each comprise two burners.

* * * * *